US009491557B2

(12) United States Patent
Fry et al.

(10) Patent No.: US 9,491,557 B2
(45) Date of Patent: Nov. 8, 2016

(54) CONNECTOR MATING ASSURANCE SYSTEM AND METHOD

(71) Applicant: Tyco Electronics Corporation, Berwyn, PA (US)

(72) Inventors: Charles David Fry, New Bloomfield, PA (US); Khalil John Maalouf, Chambersburg, PA (US); Abraham L. Shocket, Cary, NC (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 327 days.

(21) Appl. No.: 14/047,669

(22) Filed: Oct. 7, 2013

(65) Prior Publication Data

US 2015/0098574 A1 Apr. 9, 2015

(51) Int. Cl.

*H04R 29/00* (2006.01)
*H04R 1/08* (2006.01)
(Continued)

(52) U.S. Cl.

CPC ..... *H04R 29/004* (2013.01); *H01R 13/641* (2013.01); *H01R 43/26* (2013.01); *H04R 1/08* (2013.01); *H04R 3/002* (2013.01)

(58) Field of Classification Search

CPC H04N 11/00; H04R 2420/05; H04R 29/004; H04R 2420/01; H04R 1/08; H04R 19/016; H04R 2225/67; H04R 2227/005; H04R 2410/01; H04R 2430/00; H04R 2499/13; H04R 25/606; H04R 27/00; H04R 3/002; H04R 3/005; H04R 3/04; H04R 3/12; H04R 2460/13; H04R 2460/01; H04R 2420/07; H04R 25/554; H04R 25/602; H04R 25/604; H04R 3/00; H04R 1/1083; H04R 1/46; H04R 2225/31; H04R 1/1016; H04R 2201/107; H04R 25/407; H04R 1/10

USPC ..... 381/56, 18, 23.1, 86, 92, 94.1, 151, 74, 381/174, 334, 315, 71.6, 312, 326, 58, 91, 381/111, 122, 17, 320, 77, 114, 123, 173, 381/335, 369, 384

See application file for complete search history.

(56) References Cited

U.S. PATENT DOCUMENTS 6,396,932 B1 * 5/2002 Tate ..... H04M 1/19 381/357
8,186,216 B2 5/2012 Ogawa et al.
(Continued)

FOREIGN PATENT DOCUMENTS

DE 103 08 403 A1 9/2004
EP 2 161 796 A1 3/2010
(Continued)

OTHER PUBLICATIONS

International Search Report, International Application No. PCT/US2014/057085, International Filing Date, Sep. 24, 2014.

*Primary Examiner* — Akelaw Teshale

(57) ABSTRACT

A connector mating assurance system includes a microphone configured to be located in a vicinity of a mating zone for electrical connectors. The microphone is configured to detect an audible sound when the electrical connectors are mated. An output unit is connected to the microphone and receives audio signals from the microphone. The output unit processes the audio signals for mating assurance. The output unit may provide feedback to an assembler based on the audio signals. The output unit may determine if the electrical connectors are properly mated based on the audio signals. The microphone may be held by the assembler proximate to the assembler's hand when assembling the electrical connectors.

21 Claims, 3 Drawing Sheets

(51) Int. Cl.

| | |
|---|---|
| ***H04R 3/00*** | (2006.01) |
| ***H01R 13/641*** | (2006.01) |
| ***H01R 43/26*** | (2006.01) |

(56) References Cited

U.S. PATENT DOCUMENTS

2009/0310795 A1* 12/2009 Apsey ..... G10L 21/0208 381/71.1
2010/0215183 A1* 8/2010 Hansson ..... H04R 1/1033 381/58
2010/0242599 A1* 9/2010 Ogawa ..... H01R 43/26 73/488
2014/0203945 A1* 7/2014 Benner ..... G08B 21/18 340/687

FOREIGN PATENT DOCUMENTS

| | | | |
|---|---|---|---|
| JP | 03297080 | A | 12/1991 |
| JP | 07185952 | A | 7/1995 |
| JP | 2006-221971 | A | 8/2006 |
| JP | 2007-004073 | A | 1/2007 |
| JP | 2008-226506 | A | 9/2008 |

* cited by examiner

CONNECTOR MATING ASSURANCE SYSTEM AND METHOD

BACKGROUND OF THE INVENTION

The subject matter herein relates generally to connector mating assurance systems and methods.

Insuring that mating pairs of electrical connectors are mated properly is important in electrical systems, particularly in electrical systems that exhibit vibration during operation, such as in automotive applications. For example, an electrical connector can be partially mated during a car assembly process, such as in a car assembly factory, and can pass conventional electrical assurance tests, such as tests that pass electrical signals through the electrical connectors to determine electrical connection of the connectors. However, once in operation, the car vibration can cause the electrical connectors to come loose and cause failure.

Conventional assembly methods for electrical connectors provide a mating mechanism, such as a latch, that produces a click when the latch latches in place. However, in an assembly situation, a worker may not properly hear the click due to background factory noises, or could confuse the click with other sounds that closely resemble a connector click. Some known systems use a double casing of the connector, where a second case only fits if the electrical connectors were properly mated. However, such systems have increased cost associated with the second case and increased labor time to assemble.

A need remains for a connector mating assurance system and method to detect proper mating of electrical connectors.

BRIEF DESCRIPTION OF THE INVENTION

In one embodiment, a connector mating assurance system is provided including a microphone configured to be located in a vicinity of a mating zone for electrical connectors. The microphone is configured to detect an audible sound when the electrical connectors are mated. An output unit is connected to the microphone and receives audio signals from the microphone. The output unit processes the audio signals for mating assurance. The output unit may provide feedback to an assembler based on the audio signals. Optionally, the output unit may determine if the electrical connectors are properly mated based on the audio signals. The microphone may be held by the assembler proximate to the assembler's hand when assembling the electrical connectors.

Optionally, the output unit may filter background noise to enhance the audio signals. The connector mating assurance system may include a second microphone to detect the background noise. The output unit may compare audio signals from the microphones to isolate the audible sounds associated with mating of the electrical connector from the background noise.

Optionally, the microphone detects the audible sound that occurs when a latch of one electrical connector latches to the corresponding electrical connector. The output unit may provide visual feedback to the assembler at a display screen based on the audio signals. The output unit may provide audio feedback to the assembler based on the audio signals.

Optionally, the output unit may compare the audio signal to one or more templates to determine the type of electrical connectors mated. The output unit may differentiate different types of electrical connectors based on the audio signals from the microphone. The output unit may provide different feedback based on the different types of electrical connectors mated. The output unit may be calibrated by determining audio signatures for each of the different types of electrical connectors. The output unit may process the audio signals by comparing the audio signals to the audio signatures to determine which electrical connectors were mated based on the audio signals received at the output unit.

In another embodiment, a connector mating assurance system is provided including a microphone worn by an assembler and configured to be located in a vicinity of a mating zone for electrical connectors. The microphone detects an audible sound when the electrical connectors are mated. A speaker is connected to the microphone and receives audio signals from the microphone. The speaker outputs sound to the assembler based on the audio signals.

In a further embodiment, a method of detecting electrical connector mating is provided that includes positioning a microphone in a vicinity of a mating zone for the electrical connectors, detecting an audible sound with the microphone when the electrical connectors are mated, transmitting audio signals based on the audible sounds detected by the microphone to an output unit, processing the audio signals at the output unit, and providing feedback to an assembler based on the audio signals.

DETAILED DESCRIPTION OF THE INVENTION

Figure 1:
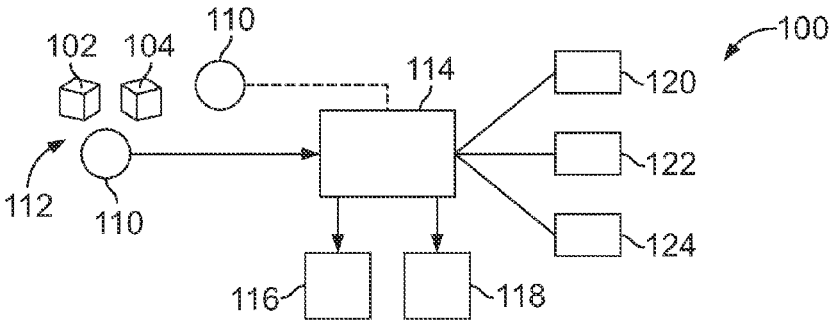
FIG. 1 illustrates a connector mating assurance system formed in accordance with an exemplary embodiment.

FIG. 1 illustrates a connector mating assurance system 100 formed in accordance with an exemplary embodiment. The connector mating assurance system 100 provides feedback to an assembler to confirm that a pair of electrical connectors 102, 104 is properly mated. In an exemplary embodiment, the connector mating assurance system 100 detects an audible sound when the electrical connectors 102, 104 are mated. The connector mating assurance system 100 may use real time signal processing for mating assurance. The connector mating assurance system 100 provides feedback to the assembler that the electrical connectors 102, 104 are properly mated. The audible verification aspect of the connector mating assurance system 100 may be used in conjunction with an electronic verification system or other quality control systems that tests the electrical connection between the electrical connectors 102, 104 as a secondary verification system.

The connector mating assurance system 100 includes a microphone 110 that is located in a vicinity of a mating zone 112 for the electrical connectors 102, 104. The microphone 110 is connected to an output unit 114 and the output unit 114 receives audio signals from the microphone 110. The microphone may be connected to the output unit 114 by a wired or a wireless connection. The output unit 114 may be a computer that processes the audio signals and provides feedback to the assembler based on the audio signals. The output unit 114 determines if the electrical connectors 102, 104 are properly mated based on the audio signals as a form of audible verification of proper mating. The output unit 114 may filter background noise to enhance the audible sound for the assembler. For example, the connector mating assurance system 100 may include a second microphone 110 that listens for background noise and the output unit 114 may compare the audio signals from the microphones 110 to isolate the audible sounds associated with mating the electrical connectors 102, 104 from the background noise. The output unit 114 may have other means of filtering the background noise detected by one or both microphones 110.

In an exemplary embodiment, the microphone 110 may be held by the assembler proximate to the assembler's hand. For example, the microphone 110 may be strapped to the assemblers hand or may be integrated into a glove worn by the assembler. Alternatively, the microphone 110 may be positioned within the mating zone 112 in the vicinity where the assembler is mating the electrical connectors 102, 104. The microphone 110 may be embedded into or otherwise coupled to the electrical connectors 102 and/or 104.

In an exemplary embodiment, the connector mating assurance system 100 may be adapted for use in an area where visibility of and accessibility to the mating zone 112 is limited. For example, the electrical connectors 102, 104 maybe part of wire harnesses that are assembled and mated during assembly of a car in an automotive plant. The electrical connectors 102, 104 may be mated in an area under the hood, behind the engine, behind the dashboard, under a seat, or in other difficult to see areas, making use of the audible clicking sound when the electrical connectors 102, 104 are mated. The connector mating assurance system 100 enhances the audible sound providing various types of feedback to the assembler to ensure that the electrical connectors 102, 104 are properly mated. Additionally, the mating of the electrical connectors 102, 104 may occur in a noisy environment, such as in an assembly plant, manufacturing plant or elsewhere where the audible click made when the latch of the electrical connectors 102, 104 latches may be unheard by the assembler.

Figure 2:
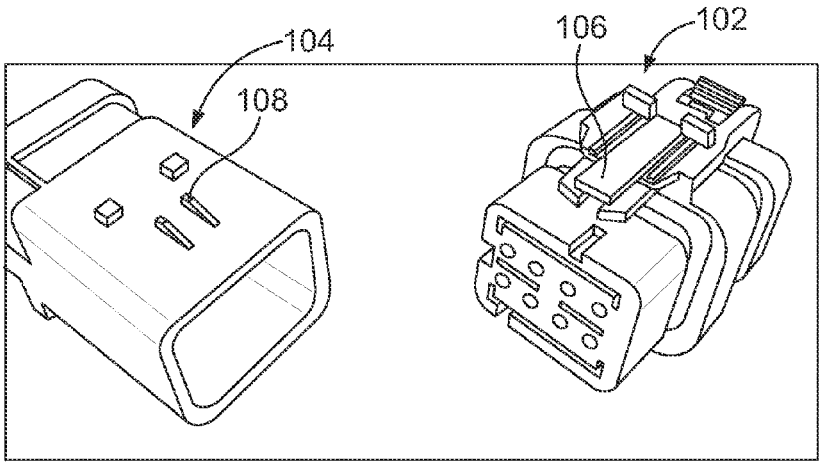
FIGS. 2 and 3 illustrate exemplary embodiments of different types of electrical connectors.
Figure 3:
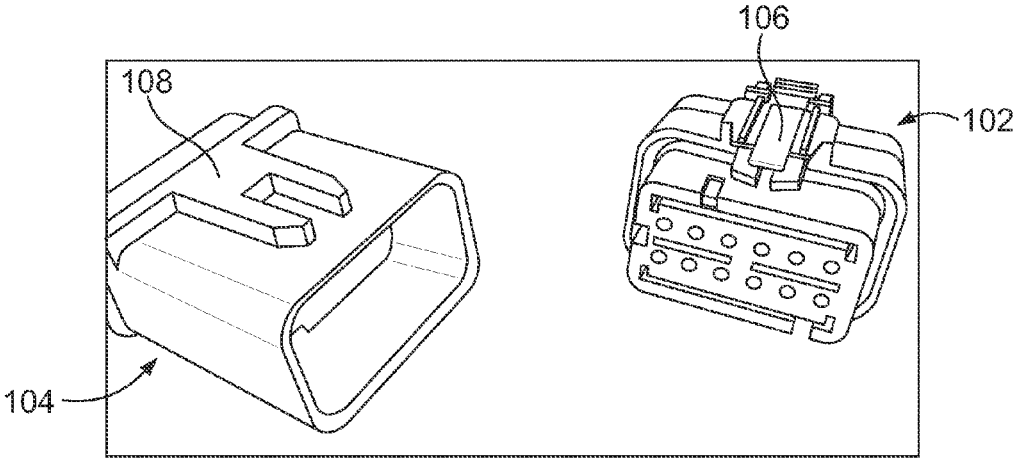

The electrical connectors 102, 104 may be any type of electrical connectors. In an exemplary embodiment, the connector mating assurance system 100 may be used during assembly of automotive electrical connectors. The electrical connectors 102, 104 may be AMP® sealed or unsealed connectors, such as those commercially available from Tyco Electronics, Harrisburg Pa. FIGS. 2 and 3 illustrate exemplary embodiments of different types of electrical connectors 102, 104. For example, FIG. 2 illustrates an eight position header and an eight position receptacle having eight contacts and associated wires extending therefrom. The electrical connectors 102, 104 illustrated in FIG. 3 are twelve position header and receptacle connectors having twelve contacts and associated wires. Other types of electrical connectors 102, 104 may be provided in alternative embodiments, such as two position connectors, four position connectors, six position connectors, fourteen position connectors, and the like. Other types of electrical connectors 102, 104 other than rectangular connectors, such as circular connectors, may be provided in other alternative embodiments. The electrical connectors 102 and/or 104 may be board mounted connectors rather than being cable or wire connectors, such as a header connector that is integrated or coupled to equipment or components within the vehicle.

The connector mating assurance system 100 may be used for connector identification purposes, such as to identify latching of the eight position connectors as compared to the twelve position connectors (or other types of connectors). The header electrical connectors 102 include a deflectable latch 106 and the receptacle electrical connectors 104 include a catch 108 for the latch 106. Optionally, the latch 106 of the twelve position header connector (FIG. 3) may be different than the latch 106 of the eight position header electrical connector 102 (FIG. 2). For example, the latches 106 may have different lengths, may be made of different materials, may have different shapes, and the like. The catches 108 may have different sizes, shapes, number of teeth, and the like. The different latches 106 and/or catches 108 have different audio signatures when latching to the corresponding catches 108. For example, when the latch 106 engages the catch 108 an audible click may be made, such as when the latch 106 snaps down into position behind the catch 108 (or multiple clicks may be heard when multiple teeth are provided). The latch 106 and/or catch may be designed to have prominent audio signatures. Providing different latches 106 and/or catches 108 provides different audio signatures when the electrical connectors 102, 104 are mated. The connector mating assurance system 100 may be configured to differentiate between the different audio signatures of the different types of electrical connectors 102, 104 to identify the particular electrical connectors 102, 104 that are mated.

Returning to FIG. 1, the microphone 110 detects the latch click(s) that occurs when the latch 106 is latched, signifying that the electrical connectors 102, 104 are properly mated. The audio signal, including the audio signal corresponding to the latch click, is transmitted to the output unit 114. The output unit 114 processes the audio signal and provides feedback to the assembler.

In an exemplary embodiment, the output unit 114 provides audible feedback to the assembler based on the audio signals. For example, a speaker 116 may be coupled to the output unit 114 and output from the output unit 114 may cause the speaker 116 to provide audible feedback. The speaker 116 may enhance (e.g., make louder) the click detected by the microphone 110 to make it easier or possible for the assembler to hear.

In an exemplary embodiment, the output unit 114 provides visual feedback to the assembler at a display screen 118 coupled to the output unit 114. The display screen 118 may be a stationary monitor, such as a monitor setting on a desk, integrated into a computer or other system, or mounted to a wall, or may be a portable monitor, such as a monitor configured to be worn by or carried by the assembler. The display screen 118 may display visual confirmation that proper mating has occurred based on the audio signals processed by the output unit 114, such as by displaying a particular color, displaying a particular icon, displaying words and/or symbols, and the like. The output unit 114 may determine the type of the electrical connectors 102, 104 mated (e.g., eight position versus twelve position versus another type) and may display information relating to the particular type of electrical connectors 102, 104 that have been mated. For example, during a particular assembly, the assembler may need to mate a four position connector, an eight position connector and a twelve position connector. After the assembler performs the mating, the assembler may refer to the display screen 118 to verify that all three connectors where mated. The display screen 118 may indicate that only two of the connectors were actually mated, causing the assembler to return to the vehicle and figure out which connector was not properly mated. Alternatively, the output unit 114 may identify which of the connectors were mated based on the audio signals and indicate on the display screen 118 which of the three connectors were properly mated and/or which of the three connectors were not properly mated.

In an exemplary embodiment, the output unit 114 may include or be coupled to a template module 120 that includes different templates of audio signatures (examples shown in FIG. 4) of different types of electrical connectors 102, 104 (e.g., 2 position, 4 position, 6 position, 8 position, 12 position, etc.). The output unit 114 may compare the received audio signal from the microphone 110 to the various templates to determine which type of electrical connectors 102, 104 was mated. For example, the template module 120 may have different time domain characteristics and/or frequency domain characteristics for the different types of electrical connectors 102, 104. The output unit 114 may correlate the audio signals against time domain templates and/or frequency domain templates to identify the particular type of electrical connectors 102, 104 that are mated.

In an exemplary embodiment, the output unit 114 may include or be coupled to a calibration module 122 that is used to calibrate the output unit 114 and/or the template module 120. For example, in a calibration mode, the electrical connectors 102, 104 may be mated, preferably numerous times to increase the amount of data to calibrate the output unit 114 and/or template module 120. Time domain characteristics, frequency domain characteristic and/or other characteristics of the audio signal associated with the mating (e.g. the click) detected by the microphone 110 may be recorded and a median or average time domain template, frequency domain template and/or other type of template may be determined for each type of electrical connector 102, 104 (e.g., 2 position, 4 position, 6 position, 8 position, 12 position, etc.) that may be assembled and monitored by the connector mating assurance system 100. The output unit 114 may be calibrated and programmed for use with any number of different types of electrical connectors 102, 104. Based on the unique signatures of the audible sound made when the particular types of electrical connectors 102, 104 are mated, the output unit 114 is able to identify and determine exactly which type of electrical connectors 102, 104 have been mated at any particular time. The output unit 114 provides feedback at the display screen 118 for the assembler to identify which types of electrical connectors 102, 104 have been mated.

In an exemplary embodiment, the output unit 114 includes or is electrically connected to any electronic verification module 124. The electronic verification module 124 sends signals through the electrical connectors 102, 104 to verify that the electrical connectors 102, 104 are electrically connected. The output unit 114 may verify which electrical connectors 102, 104 have affirmatively passed the electronic verification module 124 and compare such list of electrical connectors 102, 104 with the list of electrical connectors 102, 104 that have affirmatively passed audible verification. Data from the output unit 114 and/or electronic verification module 124 may be sent to a master quality control database or system on the vehicle or at the assembly plant for review and/or verification of successful assembly of the electrical connectors 102, 104. Such information may be combined with information from other modules or systems.

As used herein, the terms "system," "unit," or "module" may include a hardware and/or software system that operates to perform one or more functions. For example, a module, unit, or system may include a computer processor, controller, or other logic-based device that performs operations based on instructions stored on a tangible and non-transitory computer readable storage medium, such as a computer memory. Alternatively, a module, unit, or system may include a hard-wired device that performs operations based on hard-wired logic of the device. Various modules or units shown in the attached figures may represent the hardware that operates based on software or hardwired instructions, the software that directs hardware to perform the operations, or a combination thereof.

"Systems," "units," or "modules" may include or represent hardware and associated instructions (e.g., software stored on a tangible and non-transitory computer readable storage medium, such as a computer hard drive, ROM, RAM, or the like) that perform one or more operations described herein. The hardware may include electronic circuits that include and/or are connected to one or more logic-based devices, such as microprocessors, processors, controllers, or the like. These devices may be off-the-shelf devices that are appropriately programmed or instructed to perform operations described herein from the instructions described above. Additionally or alternatively, one or more of these devices may be hard-wired with logic circuits to perform these operations.

It should be noted that the particular arrangement of components (e.g., the number, types, placement, or the like) of the illustrated embodiments may be modified in various alternate embodiments. In various embodiments, different numbers of a given module or unit may be employed, a different type or types of a given module or unit may be employed, a number of modules or units (or aspects thereof) may be combined, a given module or unit may be divided into plural modules (or sub-modules) or units (or sub-units), a given module or unit may be added, or a given module or unit may be omitted.

It should be noted that the various embodiments may be implemented in hardware, software or a combination thereof. The various embodiments and/or components, for example, the units, modules, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as a solid state drive, optical drive, and the like. The storage device may also be other similar means for loading computer programs or other instructions into the computer or processor.

As used herein, the term "computer" and "controller" may each include any processor-based or microprocessor-based system including systems using microcontrollers, reduced instruction set computers (RISC), application specific integrated circuits (ASICs), logic circuits, GPUs, FPGAs, and any other circuit or processor capable of executing the functions described herein. The above examples are exemplary only, and are thus not intended to limit in any way the definition and/or meaning of the term "controller" or "computer."

The computer, module, or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer, module, or processor as a processing machine to perform specific operations such as the methods and processes of the various embodiments described and/or illustrated herein. The set of instructions may be in the form of a software program. The software may be in various forms such as system software or application software and which may be embodied as a tangible and non-transitory computer readable medium. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program. The individual components of the various embodiments may be virtualized and hosted by a cloud type computational environment, for example to allow for dynamic allocation of computational power, without requiring the user concerning the location, configuration, and/or specific hardware of the computer system.

Figure 4:
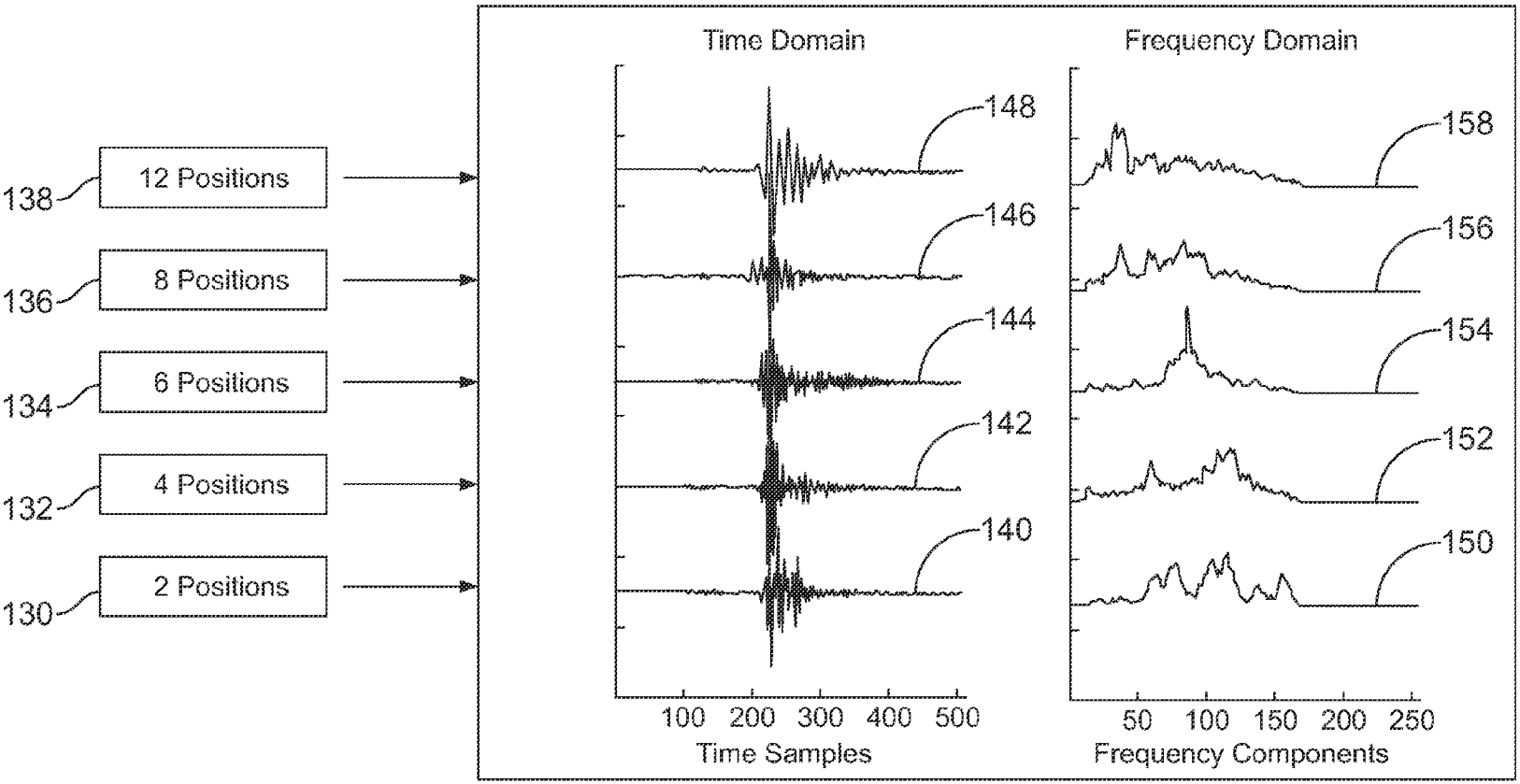
FIG. 4 illustrates exemplary templates of audio signatures corresponding to latching or mating of different pairs of electrical connectors.

FIG. 4 illustrates exemplary templates of audio signatures corresponding to latching or mating (e.g., audible click) of different pairs of electrical connectors 130, 132, 134, 136, 138. The pairs of electrical connectors 130, 132, 134, 136, 138 may be 2 position, 4 position, 6 position, 8 position, and 12 position electrical connectors, respectively; however templates for other types of connectors may be developed in other embodiments. FIG. 4 illustrates time domain templates 140, 142, 144, 146, 148 for the five different pairs of electrical connectors 130, 132, 134, 136, 138, respectively. Each of the time domain templates 140, 142, 144, 146, 148 have unique signatures. FIG. 4 illustrates frequency domain templates 150, 152, 154, 156, 158 for the five different pairs of electrical connectors 130, 132, 134, 136, 138, respectively. Each of the frequency domain templates 150, 152, 154, 156, 158 have unique signatures. The time domain templates 140, 142, 144, 146, 148 and/or frequency domain templates 150, 152, 154, 156, 158 may be compared to any audio signal received at the connector mating assurance system 100 (shown in FIG. 1) to detect the click sound and determine the type of connectors that are mated.

Figure 5:
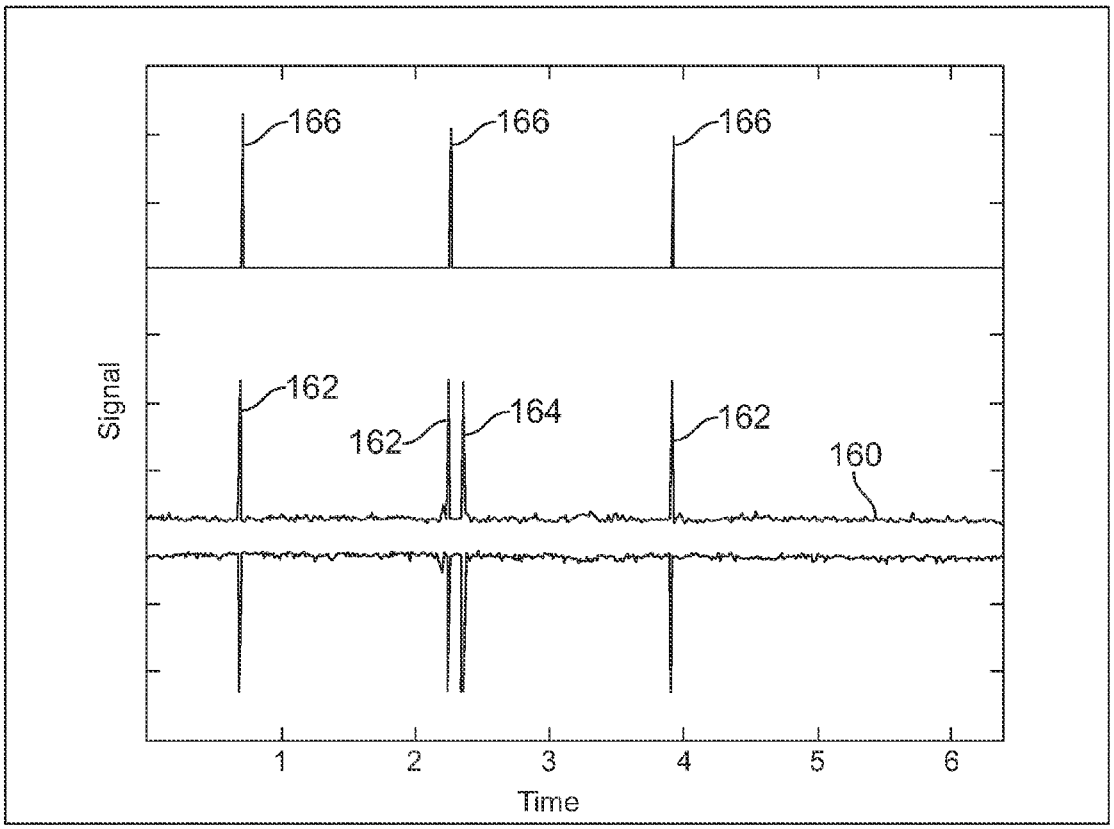
FIG. 5 is a chart showing audible detection of latching or mating of electrical connectors using the connector mating assurance system.

FIG. 5 is a chart showing audible detection of latching or mating of connectors using the connector mating assurance system 100 (shown in FIG. 1). The recorded data 160 is processed by the output unit 114 over time. The output unit 114 detects events 162, which may correspond to latching or mating of the connectors, and false events 164, which may occur when the microphone 110 touches something, when the connectors touch some other component, such as if the connectors are touched together but not mated or if the connectors are dropped, when other noises occur in the assembly facility, such as using other tools or machines around the assembly factory, and the like. The false events 164 may be identified by the output unit 114, such as by analyzing the audio signature of such false events 164 and comparing the audio signature to the templates. The events 162 are verified by comparing the audio signatures of the recorded data 160 to the templates. The time domain templates 140, 142, 144, 146, 148 and/or frequency domain templates 150, 152, 154, 156, 158 may be used to compare to the recorded data 160. When an event 162 is detected, the output unit 114 may provide audible, visual or other feedback outputs 166 to the assembler to confirm that the connectors are properly mated.

Figure 6:
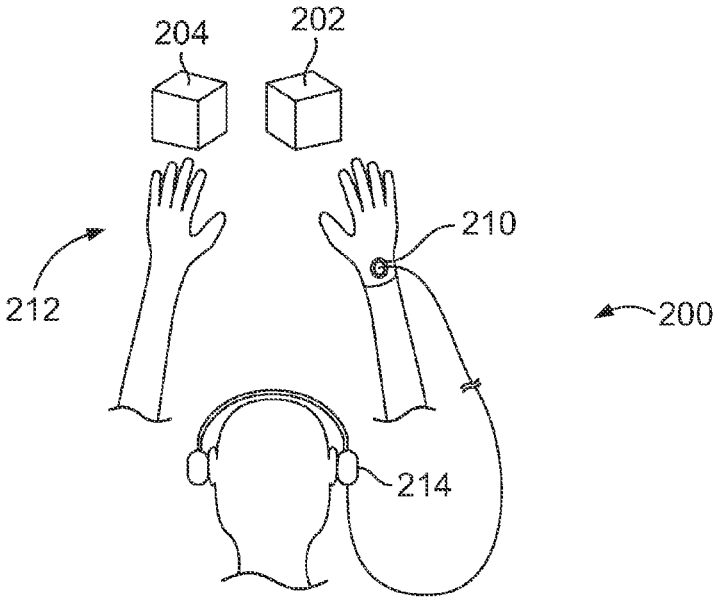
FIG. 6 illustrates a connector mating assurance system formed in accordance with an exemplary embodiment.

FIG. 6 illustrates a connector mating assurance system 200 formed in accordance with an exemplary embodiment. The connector mating assurance system 200 provides audible feedback to an assembler to confirm that a pair of electrical connectors 202, 204 is properly mated. In an exemplary embodiment, the connector mating assurance system 200 detects an audible sound when the electrical connectors 202, 204 are mated.

The connector mating assurance system 200 includes a microphone 210 that is located in a vicinity of a mating zone 212 for the electrical connectors 202, 204. In an exemplary embodiment, the microphone 210 may be held by the assembler proximate to the assembler's hand. For example, the microphone 210 may be strapped to the assemblers hand or may be integrated into a glove worn by the assembler. Alternatively, the microphone 210 may be positioned within the mating zone 212 in the vicinity where the assembler is mating the electrical connectors 202, 204. The microphone 210 may be embedded into or otherwise coupled to the electrical connectors 202 and/or 204.

The microphone 210 is connected to an output unit 214 and the output unit 214 receives audio signals from the microphone 210. The output unit 214 processes the audio signals and provides an audible output or feedback. In an exemplary embodiment, the output unit 214 is a speaker that provides an audible output. The output unit 214 may be an ear bud or headphone worn by the assembler to provide audible feedback to the assembler based on the audio signals. The connector mating assurance system 200 enhances the audible sound providing various types of feedback to the assembler to ensure that the electrical connectors 202, 204 are properly mated. The output unit 214 may filter background noise to enhance the audible sound for the assembler.

To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or random access memory, hard disk, or the like) or multiple pieces of hardware. Similarly, the programs may be stand-alone programs, may be incorporated as subroutines in an operating system, may be functions in an installed software package, and the like. It should be understood that the various embodiments are not limited to the arrangements and instrumentality shown in the drawings.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector mating assurance system comprising:

a microphone configured to be located in a vicinity of a mating zone for electrical connectors, the microphone configured to detect an audible sound when the electrical connectors are mated; and an output unit connected to the microphone and receiving audio signals from the microphone, the output unit processing the audio signals for mating assurance, wherein the output unit differentiates between a plurality of different types of electrical connectors based on the audio signals from the microphone.

2. The connector mating assurance system of claim 1, wherein the output unit provides feedback to an assembler based on the audio signals.

3. The connector mating assurance system of claim 1, wherein the output unit filters background noise to enhance the audio signals.

4. The connector mating assurance system of claim 3, further comprising a second microphone to detect the background noise, the output unit comparing audio signals from the microphones to isolate the audible sounds associated with mating of the electrical connector from the background noise.

5. The connector mating assurance system of claim 1, wherein the microphone detects the audible sound that occurs when a latch of one electrical connector latches to the corresponding electrical connector.

6. The connector mating assurance system of claim 1, wherein the output unit provides visual feedback to an assembler at a display screen based on the audio signals.

7. The connector mating assurance system of claim 1, wherein the output unit provides audio feedback to an assembler based on the audio signals.

8. The connector mating assurance system of claim 1, wherein the output unit compares the audio signal to one or more templates to determine the type of electrical connectors mated.

9. The connector mating assurance system of claim 1, wherein the output unit is configured to provide different feedback to an assembler based on the different types of electrical connectors mated.

10. The connector mating assurance system of claim 1, wherein the output unit is calibrated by determining audio signatures for each of the different types of electrical connectors, the output unit processing the audio signals by comparing the audio signals to the audio signatures to determine which electrical connectors were mated based on the audio signals received at the output unit.

11. The connector mating assurance system of claim 1, wherein the microphone is configured to be held by an assembler proximate to the assembler's hand.

12. The connector mating assurance system of claim 1, wherein the output unit differentiates between the different types of electrical connectors by comparing the audio signals to unique audio signatures associated with the different types of electrical connectors.

13. A connector mating assurance system comprising:

a microphone worn by an assembler and configured to be located in a vicinity of a mating zone for electrical connectors, the microphone detecting an audible sound when the electrical connectors are mated;

an output unit connected to the microphone and receiving audio signals from the microphone, the output unit processing the audio signals for mating assurance, wherein the output unit differentiates between a plurality of different types of electrical connectors based on the audio signals from the microphone and determine the type of electrical connectors mated based on the audio signals; and a speaker connected to the output unit, the speaker outputting sound to the assembler based on the audio signals from the microphone.

14. The connector mating assurance system of claim 13, wherein the speaker is an ear bud or headphone worn by the assembler proximate the assembler's ear.

15. The connector mating assurance system of claim 13, wherein the speaker enhances the audible signal from the microphone to produce an enhanced audible sound.

16. The connector mating assurance system of claim 13, wherein the output unit filters background noise to enhance the audio signals.

17. A method of detecting electrical connector mating, the method comprising:

positioning a microphone in a vicinity of a mating zone for the electrical connectors;

detecting an audible sound with the microphone when the electrical connectors are mated;

transmitting audio signals based on the audible sounds detected by the microphone to an output unit;

processing the audio signals at the output unit to differentiate between a plurality of different types of electrical connectors based on the audio signals and determine the type of electrical connectors mated based on the audio signals; and providing audible feedback to an assembler based on the audio signals.

18. The method of claim 17, wherein said providing feedback comprises providing visual feedback to the assembler at a display screen based on the audio signals.

19. The method of claim 17, wherein said processing the audio signals comprises comparing the audio signals to templates of audio signatures to verify that the electrical connectors are properly mated.

20. The method of claim 17, further comprising calibrating the output unit to detect mating of different types of electrical connectors, said processing the audio signals comprises determining the type of electrical connectors mated based on the audio signals.

21. The method of claim 17, wherein said processing the audio signals comprises reducing background noise from the audio signal.

* * * * *